US006638078B2

(12) United States Patent
Hashiguchi et al.

(10) Patent No.: US 6,638,078 B2
(45) Date of Patent: Oct. 28, 2003

(54) CONNECTOR SUITABLE FOR CONNECTING A PAIR OF CIRCUIT BOARDS ARRANGED IN PARALLEL

(75) Inventors: Osamu Hashiguchi, Akishima (JP); Takeshi Shindo, Higashiyamato (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 10/375,567

(22) Filed: Feb. 26, 2003

(65) Prior Publication Data

US 2003/0162417 A1 Aug. 28, 2003

(30) Foreign Application Priority Data

Feb. 27, 2002 (JP) ..... 2002-051894

(51) Int. Cl.[7] ..... H01R 12/22
(52) U.S. Cl. ..... 439/66; 439/74; 439/733.1
(58) Field of Search ..... 439/65, 66, 74, 439/591, 862, 733.1

(56) References Cited

U.S. PATENT DOCUMENTS 5,498,167 A * 3/1996 Seto et al. ..... 439/74
5,885,092 A * 3/1999 Ito et al. ..... 439/74
5,975,916 A * 11/1999 Okura ..... 439/74
6,039,601 A * 3/2000 Kraiczyk et al. ..... 439/500

* cited by examiner

*Primary Examiner*—Tho D. Ta
(74) *Attorney, Agent, or Firm*—Michael Best & Friedrich LLC

(57) ABSTRACT

A connector having a plate-like insulator (11) formed with spaces each extending between a first surface (11*a*) and a second surface (11*b*) confronting each other in a first direction (A1), and contacts (12) each unitarily formed and mounted in the corresponding space. The insulator has a wall portion (13) that divides each of the spaces into a first space (14) and a second space (15) in a second direction (A2). Each contact has a retained portion (16) that is retained in the first space utilizing the wall portion, and a spring portion (17) extending from the retained portion, passing on the side of the first surface to bypass the wall portion and entering the second space. The spring portion has a protruding portion (27) approaching to confront the wall portion, and a contact portion (28) protruding from the second surface to the exterior of the insulator.

12 Claims, 4 Drawing Sheets

CONNECTOR SUITABLE FOR CONNECTING A PAIR OF CIRCUIT BOARDS ARRANGED IN PARALLEL

BACKGROUND OF THE INVENTION

This application claims priority to prior application JP 2002-51894, the disclosure of which is incorporated herein by reference.

The present invention relates to a connector having an insulator and conductive contacts mounted therein and, in particular, relates to a connector that is usable upon, for example, mutually connecting two circuit boards disposed in parallel.

The insulator in this type of the connector is in the form of a plate-like member having first and second surfaces confronting each other in a first direction. The first and second surfaces are normally designed to be parallel to each other. The insulator is formed with spaces each extending between the first and second surfaces. The conductive contacts are mounted in these spaces, respectively.

In general, each contact is unitarily formed from an elastic conductive plate member by applying thereto cutting and bending processes and so forth. In the state of being mounted in the insulator, each contact has one end projected from the first surface of the insulator as a terminal portion, and the other end projected from the second surface of the insulator as a contact portion.

The connector is placed on a mount side board in the form of a circuit board with the first surface thereof confronting the mount side board, then the terminal portions of the contacts are connected to the mount side board by, for example, soldering. A connection object board in the form of another circuit board is arranged so as to confront the second surface of the connector, then is pushed toward the second surface In this manner, the contact portions of the contacts are brought into contact with the connection object board. Consequently, an electric circuit of he connection object board is connected to an electric circuit of the mount side board via the contacts.

When the connection object board is pushed toward the second surface of the insulator, the contact portion are pressed by the connection object board so that the contacts are urged. A restoring force of each contact generated in this event is transmitted not only to the contact portion but also to the terminal portion. Thus, it is possible that stress is exerted on a connecting structure, obtained by soldering or the like, between the terminal portion of the contact and the mount side board. Further, when the contact portion is pushed in a direction inclined relative to the first direction, it is possible that the contact deforms excessively in a second direction crossing the first direction, thereby to induce plastic deformation in the worst case.

SUMMARY OF THE INVENTION

It is therefore an object of he present invention to provide a connector that can prevent as much as possible a force applied to a contact portion of a contact from being transmitted to terminal portion thereof.

It is another object of the present invention to provide a connector that can prevent excessive deformation of a contact due to a force applied to a contact portion of the contact.

Other objects of the preset invention will become clear as the description proceeds.

According to one aspect o the present invention, there is provided a connector which comprises a plate-like insulator having a first and a second surface which confront each other in a first direction, and defining a space extending between the first and the second surfaces, the insulator including a wall portion dividing the space into a first space and a second space in a second direction crossing the first direction, and a conductive contact placed in the space and held by the insulator The contact includes a retained portion retained in the first space utilizing the wall portion and a spring portion extending from the retained portion, passing on the side of the first surface to bypass the wall portion and entering the second space. The spring portion includes a stopper portion approaching to confront the wall portion and a contact portion protruding from the second surface to the exterior of the insulator.

According to another aspect of the present invention, there is obtained a connector which comprises a plate-like insulator having a first and a second surface which confront each other n a first direction, and defining a plurality of spaces each extending between the first and the second surfaces, the insulator including a plurality of wall portions each dividing each of the spaces into a first space and a second space in a second direction crossing the first direction, the spaces being arranged in a third direction perpendicular to the first and the second directions, and a plurality o conductive contacts placed in the spaces, respectively, and held by the insulator. Each of the contacts includes a retained portion that is retained in the first space utilizing the wall portion and a spring portion extending from the retained portion, passing on the side of the first surface to bypass the wall portion and entering the second space. The spring portion includes a stopper portion approaching to confront the wall portion and a contact portion protruding from the second surface to the exterior of the insulator.

According to still another aspect of the present invention, there is obtained a connector comprising a contact and an insulator firmly retaining the contact, wherein the contact comprises a first U-shaped portion, a second U-shaped portion, and a third U-shaped portion, the insulator has an insert portion into which the first U-shaped portion is inserted, the first U-shaped portion and the second U-shaped portion being provided inversely from each other so as to form substantially an S shape, the third U-shaped portion extending from the second U-shaped portion to have a contact portion near an apex portion thereof for connection to a connection object, the first U-shaped portion having one end side firmly retained in the insert portion and the other end side contacting a first side of a wall portion of the insert portion, upon connection to the connection object, one end side of the second U-shaped portion, remote from the first U-shaped portion, being prevented from contacting a second side of the wall portion opposite to the first side, while upon connection to the connection object slantly relative to a connecting direction, the one end side of the second U-shaped portion contacts the second side of the wall portion, thereby to prevent an excessive displacement of the contact.

DESCRIPTION OF THE PREFERRED EMBODIMENT

Figure 1:
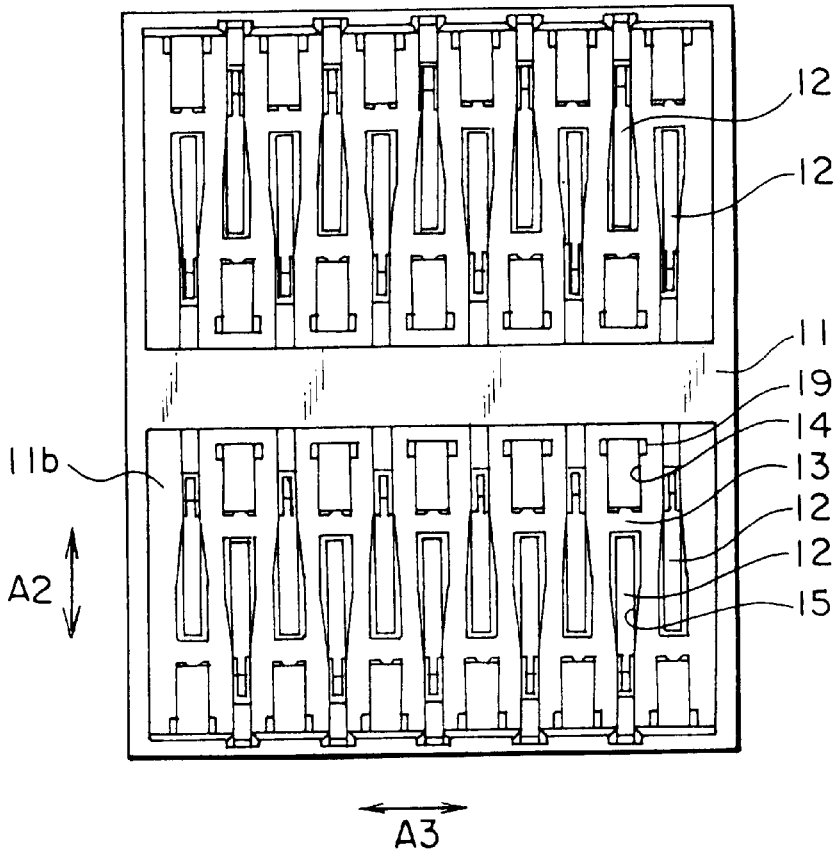
FIG. 1 is a plan view of a connector according to a preferred embodiment of the present invention.
Figure 2:
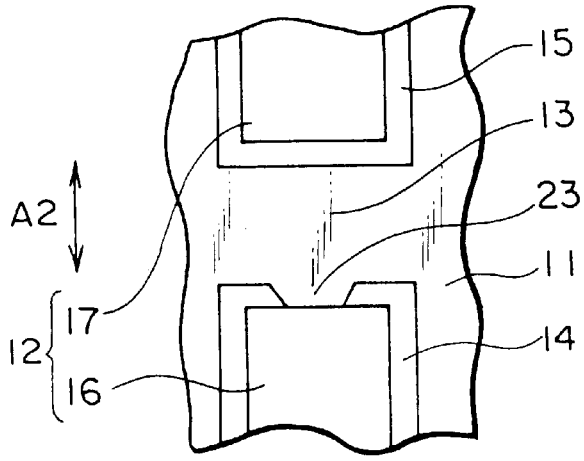
FIG. 2 is an enlarged plan view showing only the main part of the connector of FIG. 1.
Figure 3:
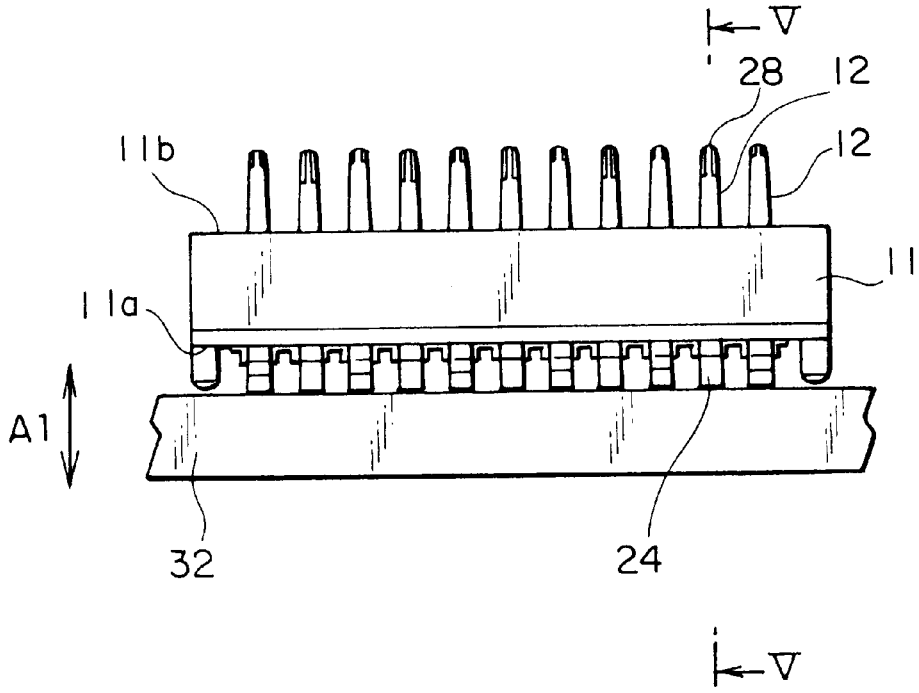
FIG. 3 is a front view showing the connector of FIG. 1 in the state wherein it is mounted on a mount side board.
Figure 4:
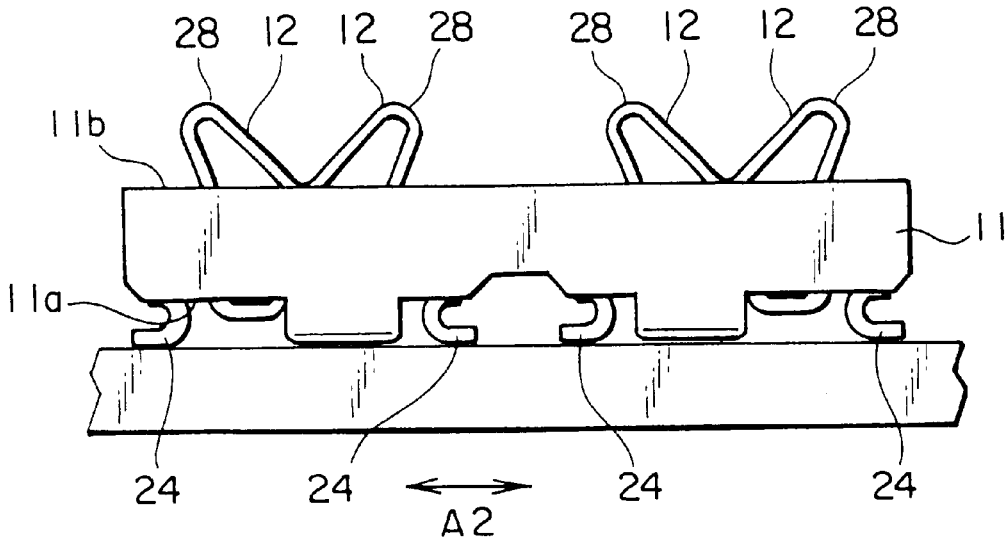
FIG. 4 is a side view showing the connector of FIG. 1 in the state wherein it is mounted on the mount side board.
Figure 5:
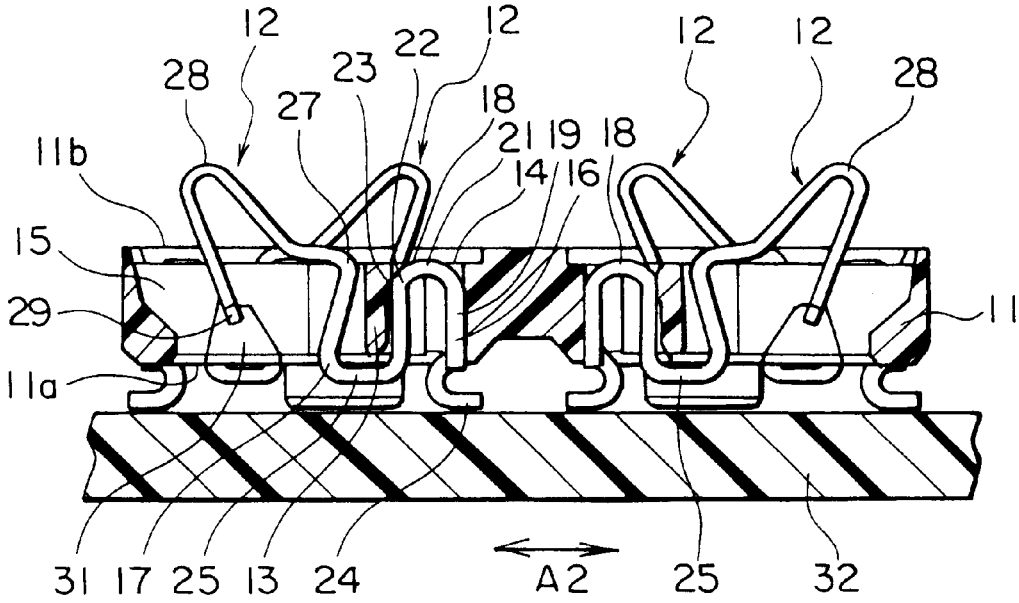
FIG. 5 is a sectional view taken along line V—V of FIG. 3.

Referring to FIGS. 1 to 5, a connector according to one preferred embodiment of the present invention will be described.

The shown connector comprises a plate-like insulator 11 and a lot of conductive contacts 12 attached to the insulator 11. The insulator 11 has a first surface 11*a* and a second surface 11*b* mutually confronting in parallel in a first direction A1. The insulator 11 is formed with a lot of spaces in two lines corresponding to the contacts 12. Each of these spaces is divided into a relatively small first space 14 and a relatively large second space 15 in a second direction A2 perpendicular to the first direction A1 by a wall portion 13 unitarily formed in the insulator 11. In each line of the spaces, the first and second spaces 14 and 15 are provided alternately. Specifically, the first and second spaces 14 and 15 are arranged alternately in a third direction A3 perpendicular to the first and second directions A1 and A2.

Each contact 12 is unitarily formed from an elastic conductive plate member by applying thereto cutting and bending processes and so forth. Each contact 12 comprises a retained portion 16 that is retained in the first space 14 utilizing the wall portion 13, and a spring portion 17 extending from the retained portion 16. The retained portion 16 has a first U-shaped portion 18 arranged in the first space 14 serving as an insert portion.

The first U-shaped portion 18 has a press-fitted portion 19 that is press-fitted into the first space 14, a curved portion 21 extending from the press-fitted portion 19, and an interference portion 22 extending from the curved portion 21. The press-fitted portion 19 is press-fitted into the first space 14 from the side of the first surface 11*a*. The wall portion 13 is formed with a convex portion or a rib 23 on the side of the first space 14, and the rib 23 is caused to interfere with the interference portion 22. In this manner, the retained portion 16 is firmly retained to the insulator 11. Since the rib 23 tends to be crushed upon press-fitting of the contact 12, contraction of the curved portion 21 upon assembling can be prevented. The contact 12 is unitarily formed with a terminal portion 24 extending from the press-fitted portion 19 to protrude from the first surface 11*a* to the exterior of the insulator 11.

On the other hand, the spring portion 17 has a second U-shaped portion 25 extending from the first U-shaped portion 18 so as to form substantially an S shape cooperatively with the first U-shaped portion 18. Passing on the side of the first surface 11*a* of the insulator 11 to bypass the wall portion 13, the second U-shaped portion 25 enters the second space 15.

A third U-shaped portion 26 extends from an end of the second U-shaped portion 25 located in the second space 15 so as to form substantially an S shape on the whole cooperatively with the second U-shaped portion 25. The third U-shaped portion 26 has a protruding portion 27 serving as a stopper portion, which approaches to confront the wall portion 13, a contact portion 28 protruding from the second surface 11*b* to the exterior of the insulator 11, and a width-increased or broadened tip 29 extending from the contact portion 28 to enter the second space 15. The insulator 11 is formed with an escape groove 31 for allowing the broadened tip 29. The contact portion 28 of one of adjacent ones of the contacts 12 is displaced from the contact portion 28 of another of the adjacent ones of the contacts 12 in the second direction A2.

The connector is placed on a mount side board 32 in the form of a circuit board with the first surface 11*a* of the insulator 11 confronting the mount side board 32. Then, the terminal portions 24 of the contacts 12 are connected to a circuit pattern (not shown) of the mount side board 32 by, for example, soldering.

Figure 6:
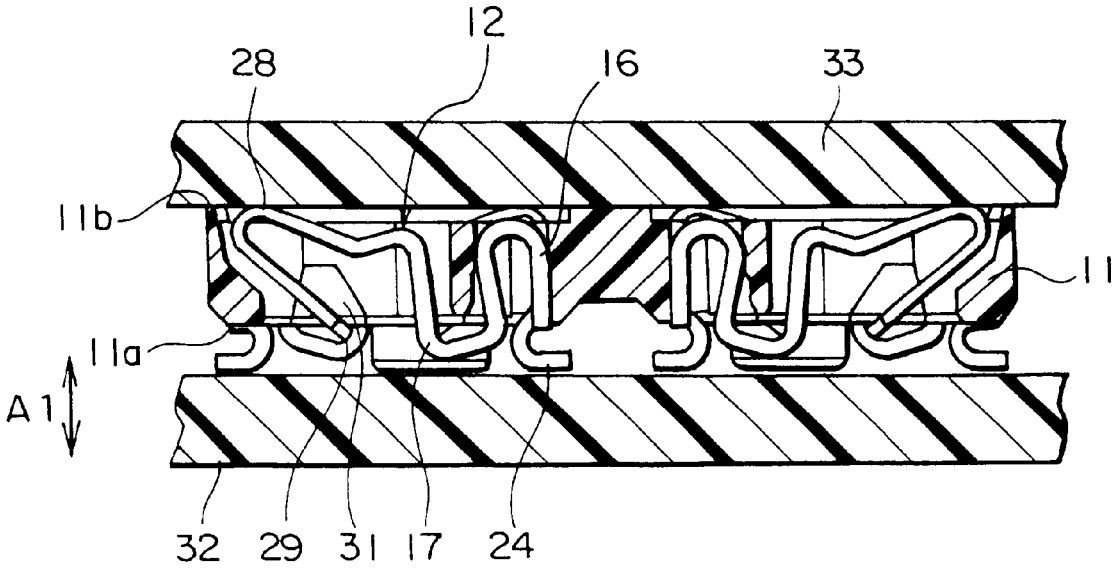
FIG. 6 is a sectional view similar to FIG. 5 in the state wherein a connection object board is connected.

As shown in FIG. 6, a connection object board 33 in the form of another circuit board is arranged so as to confront the second surface 11*b* of the insulator 11, then is pushed toward the second surface 11*b*. In this manner, the contact portions 28 of the contacts 12 are brought into contact with a circuit pattern (not shown) of the connection object board 33. Consequently, an electric circuit of the connection object board 33 is connected to an electric circuit of the mount side board 32 via the contacts 12.

When the connection object board 33 is pushed toward the second surface 11*b* of the insulator 11, the contact portions 28 are pressed by the connection object board 33 so that the contacts 12 are urged. A restoring force of each contact 12 generated in this event is transmitted to the contact portion 28, but not to the terminal portion 24 because the retained portion 16 is firmly retained to the insulator 11. Therefore, stress can be prevented as much as possible from being applied to a connecting structure, obtained by soldering or the like, between the terminal portion 24 of the contact 12 and the mount side board 32.

Further, the displacement of the tip 29 of the contact 12 is small when the connection object board 33 is connected. Therefore, the size of the connector in the first direction A1 can be reduced. Namely, reduction in height of the connector can be easily achieved.

Figure 7:
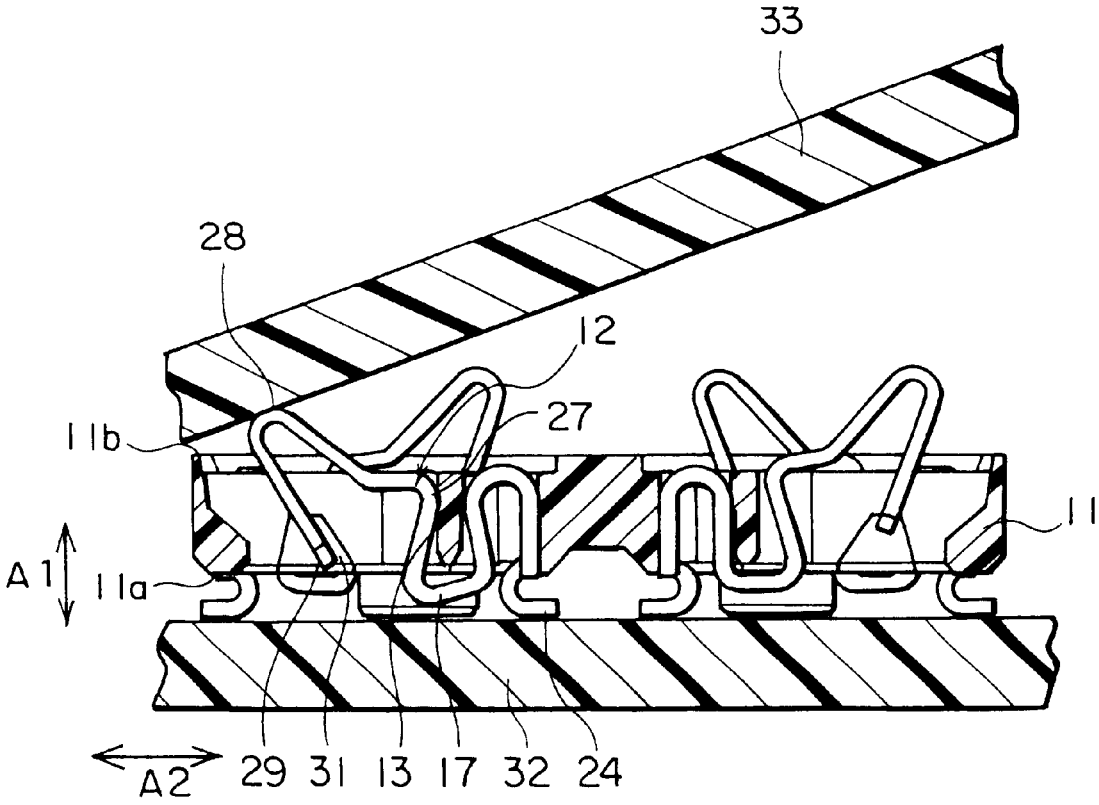
FIG. 7 is a sectional view similar to FIG. 5 in the state wherein the connection object board is under operation for connecting it in a special posture.

On the other hand, as shown in FIG. 7, it may be assumed as a special case that the connection object board 33 is mounted in a direction inclined relative to the first direction A1. In this event, although the contact portion 28 of the contact 12 is subjected to a large force in the second direction A2, excessive deformation of the contact 12, particularly the spring portion 17, and plastic deformation caused thereby can be prevented through abutment of the protruding portion 27 of the contact 12 against the wall portion 13. Naturally, no stress is exerted on the foregoing connecting structure.

While the present invention has thus far been described in connection with a few embodiments thereof, it will readily be possible for those skilled in the art to put this invention into practice in various other manners. For example, the stopper portion confronting the wall portion 13 may be formed as part of the second U-shaped portion 25.

What is claimed is:

1. A connector comprising:

a plate-like insulator having a first and a second surface which confront each other in a first direction, and defining a space extending between said first and said second surfaces, said insulator including a wall portion dividing said space into a first space and a second space in a second direction crossing said first direction; and a conductive contact placed in said space and held by said insulator, said contact including:

a retained portion retained in said first space utilizing said wall portion; and a spring portion extending from said retained portion, passing on the side of said first surface to bypass said wall portion and entering said second space, said spring portion including:

a stopper portion approaching to confront said wall portion; and a contact portion protruding from said second surface to the exterior of said insulator.

2. A connector as claimed in claim 1, wherein said contact includes a broadened tip extending from said contact portion to be located in said second space, said insulator having an escape groove for allowing said broadened tip.

3. A connector as claimed in claim 1, wherein said retained portion includes a first U-shaped portion located in said first space, said spring portion including:

a second U-shaped portion extending from said first U-shaped portion so as to form substantially an S shape cooperatively with said first U-shaped portion; and a third U-shaped portion extending from said second U-shaped portion so as to form substantially an S shape cooperatively with said second U-shaped portion, said third U-shaped portion including said stopper portion and said contact portion.

4. A connector as claimed in claim 3, wherein said contact includes a terminal portion extending from said U-shaped portion to protrude from said first surface to the exterior of said insulator.

5. A connector as claimed in claim 3, wherein said first U-shaped portion comprises:

a press-fitted portion press-fitted into said first space;

a curved portion extending from said press-fitted portion; and an interference portion extending from the curved portion, said wall portion is formed with a convex portion which is protruded towards said first space to interfere with said interference portion.

6. A connector comprising:

a plate-like insulator having a first and a second surface which confront each other in a first direction, and defining a plurality of spaces each extending between said first and said second surfaces, said insulator including a plurality of wall portions each dividing each of said spaces into a first space and a second space in a second direction crossing said first direction, said spaces being arranged in a third direction perpendicular to said first and said second directions; and a plurality of conductive contacts placed in said spaces, respectively, and held by said insulator, each of said contacts including:

a retained portion retained in said first space utilizing said wall portion; and a spring portion extending from said retained portion, passing on the side of said first surface to bypass said wall portion and entering said second space, said spring portion including:

a stopper portion approaching to confront said wall portion; and a contact portion protruding from said second surface to the exterior of said insulator.

7. A connector as claimed in claim 6, wherein each of said contact includes a broadened tip extending from said contact portion to be located in said second space, said insulator having an escape groove for allowing said broadened tip.

8. A connector as claimed in claim 6, wherein the contact portion of one of adjacent ones of said contacts is displaced from the contact portion of another of said adjacent ones in said second direction.

9. A connector as claimed in claim 6, wherein said retained portion includes a first U-shaped portion located in said first space, said spring portion including:

a second U-shaped portion extending from said first U-shaped portion so as to form substantially an S shape cooperatively with said first U-shaped portion; and a third U-shaped portion extending from said second U-shaped portion so as to form substantially an S shape cooperatively with said second U-shaped portion, said third U-shaped portion including said stopper portion and said contact portion.

10. A connector as claim 9, wherein each of said contacts includes a terminal portion extending from said U-shaped portion to protrude from said first surface to the exterior of said insulator.

11. A connector as claimed 9, in claim wherein said first U-shaped portion comprises:

a press-fitted portion press-fitted into said first space;

a curved portion extending from said press-fitted portion; and an interference portion extending from the curved portion, each of said wall portion being formed with a convex portion which is protruded towards said first space to interfere with said interference portion.

12. A connector comprising a contact and an insulator firmly retaining said contact, wherein said contact comprises:

a first U-shaped portion;

a second U-shaped portion; and a third U-shaped portion, said insulator has an insert portion into which said first U-shaped portion is inserted, said first U-shaped portion and said second U-shaped portion being provided inversely from each other so as to form substantially an S shape, said, third U-shaped portion extending from said second U-shaped portion to have a contact portion near an apex portion thereof for connection to a connection object, said first U-shaped portion having one end side firmly retained in said insert portion and the other end side contacting a first side of a wall portion of said insert portion, upon connection to said connection object, one end side of said second U-shaped portion, remote from said first U-shaped portion, being prevented from contacting a second side of said wall portion opposite to said first side, while upon connection to said connection object slantly relative to a connecting direction, said one end side of said second U-shaped portion contacts said second side of said wall portion, thereby to prevent an excessive displacement of said contact.

* * * * *